US008314812B1

(12) United States Patent
Eckel

(10) Patent No.: US 8,314,812 B1
(45) Date of Patent: Nov. 20, 2012

(54) METHOD AND APPARATUS FOR DISPLAYING ANTI-ALIASED TEXT OVER GRAPHICAL DISPLAY BACKGROUND

(75) Inventor: William W. Eckel, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 907 days.

(21) Appl. No.: 12/221,525

(22) Filed: Aug. 4, 2008

(51) Int. Cl.
*G09G 5/36* (2006.01)

(52) U.S. Cl. ..... 345/611; 345/612; 345/613; 345/614; 345/615; 345/616; 345/629; 345/589; 345/590; 345/591; 345/592; 382/269

(58) Field of Classification Search ..... 345/611–616, 345/629, 589–592; 382/269
See application file for complete search history.

(56) References Cited

U.S. PATENT DOCUMENTS

| | | | | |
|---|---|---|---|---|
| 5,384,860 | A * | 1/1995 | Gardemal et al. | 382/103 |
| 5,831,627 | A * | 11/1998 | Cohen | 345/592 |
| 5,940,080 | A * | 8/1999 | Ruehle et al. | 345/611 |
| 6,329,998 | B1 * | 12/2001 | Han | 345/581 |
| 6,532,022 | B1 * | 3/2003 | Ahmad | 345/629 |
| 7,456,904 | B2 * | 11/2008 | Millar | 348/589 |
| 7,489,830 | B2 * | 2/2009 | Bloomberg et al. | 382/269 |
| 2003/0214512 | A1 * | 11/2003 | Cheng | 345/611 |
| 2005/0041036 | A1 * | 2/2005 | Narayanaswami et al. | 345/605 |
| 2005/0156871 | A1 * | 7/2005 | Ikeda | 345/108 |
| 2007/0223839 | A1 * | 9/2007 | Kisilev et al. | 382/286 |
| 2009/0051637 | A1 * | 2/2009 | Chen et al. | 345/88 |
| 2009/0135195 | A1 * | 5/2009 | Chen et al. | 345/589 |

* cited by examiner

*Primary Examiner* — Jeffery A Brier
*Assistant Examiner* — Todd Buttram
(74) *Attorney, Agent, or Firm* — Donna P. Suchy; Daniel M. Barbieri

(57) ABSTRACT

A dual image source display system with an anti-aliased textual foreground and graphic image background, where display information from each source is combined, but only after the intensity level for each given pixel color component in the graphical image background is dimmed by an amount which is equal to the highest intensity level of any pixel color component in the same pixel as the given pixel color component.

16 Claims, 1 Drawing Sheet

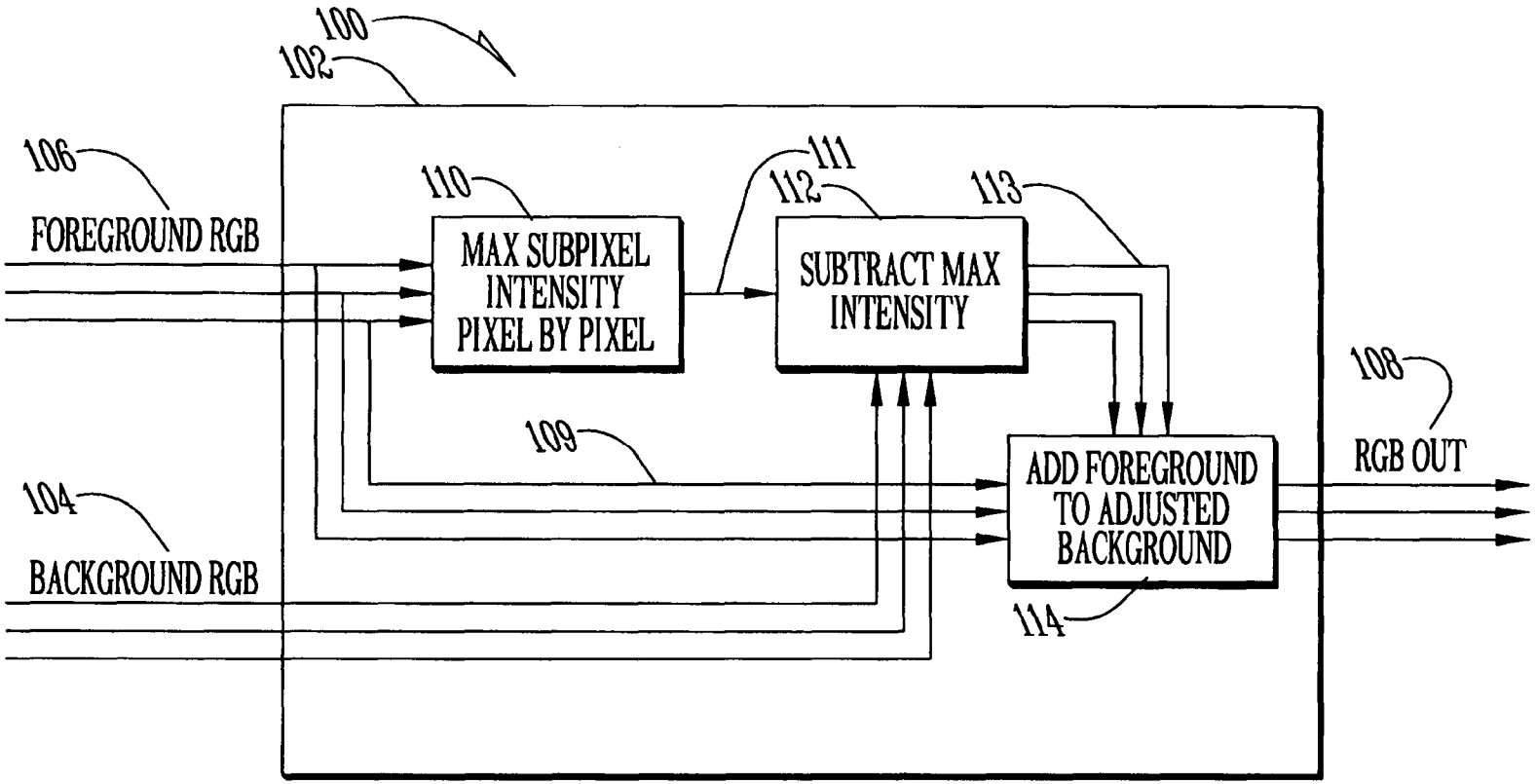
100
102
106
FOREGROUND RGB
104
BACKGROUND RGB
110
MAX SUBPIXEL INTENSITY PIXEL BY PIXEL
111
112
SUBTRACT MAX INTENSITY
113
109
ADD FOREGROUND TO ADJUSTED BACKGROUND
114
108
RGB OUT

METHOD AND APPARATUS FOR DISPLAYING ANTI-ALIASED TEXT OVER GRAPHICAL DISPLAY BACKGROUND

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. W46HZV-05-C-0724 awarded by the U.S. Army.

FIELD OF THE INVENTION

The present invention generally relates to electronic displays with anti-aliased text over a graphic display background.

BACKGROUND OF THE INVENTION

In recent years, attempts have been made to improve the appearance of video and other graphical displays which include anti-aliased text superimposed thereon.

While there has been much desire to increase the clarity and readability of such displays, it has been common to have problems displaying a graphic background from one source with a textual foreground from a different source on the same display screen. Prior art methods have often involved using extra bits of information to help combine different displays from differing sources. These extra bits of information may increase the memory requirements and certainly add complexity to the dual source display rendering task.

Consequently, there exists a need for improved methods and systems for cost effectively increasing the quality of displaying an anti-aliased textual image over a graphical background image in an efficient manner.

SUMMARY OF THE INVENTION

It is an object of the present invention to provide a system and method for displaying anti-aliased foreground text over a graphical background in a more efficient manner.

It is a feature of the present invention to make a highest pixel color component intensity level determination for each pixel in a foreground image.

It is another feature of the present invention to associate each pixel in the foreground textual image with a corresponding pixel in the background graphics image.

It is yet another feature of the present invention to add the pixel color component intensities of the textual foreground to each of the adjusted pixel color component intensity levels of the background on an individual pixel color component basis.

It is an advantage of the present invention to provide a relatively easy method for combining divergent display types on a single display.

The present invention is designed to satisfy the aforementioned needs, provide the previously stated objects, include the above-listed features, and achieve the already articulated advantages.

Accordingly, the present invention is a system and method including associating each pixel in the foreground textual images with a corresponding pixel in the background graphic image, determining a highest pixel color component intensity level for each pixel in the foreground image, subtracting the corresponding highest pixel color component intensity level from each pixel color component in every pixel in the background image; adding the intensity level of each pixel color component in the foreground to each modified intensity of a pixel color component in the background, and driving the display with the modified then combined drive signal.

BRIEF DESCRIPTION OF THE DRAWINGS

The invention may be more fully understood by reading the following description of the preferred embodiments of the invention, in conjunction with the appended drawings wherein:

FIG. 1 is a block diagram view of a field programmable gate array of the present invention.

DETAILED DESCRIPTION OF THE INVENTION

Now referring to the drawings, wherein like numerals refer to like matter throughout, and more specifically to FIG. 1, there is shown a dual source image combination system 100 for combining on a single display divergent images such as an anti-aliased foreground textual information and background photographic or video information. Dual divergent image combining FPGA 102 is shown receiving a source of background image signal 104 from a camera and source of foreground image signal 106 from a PC and outputting modified combined image output 108 to an LCD. It should be understood that any source of background image signal 104 and any source of foreground image signal 106 could be used, such as a personal computer, cameras, or other sources of digital image signals. The display could be an LCD as shown, or any type of display system capable of receiving a digital signal and displaying an image in response thereto. The dual source image combination system 100 and dual divergent image combining FPGA 102 could be made by Xilinx or Altera. Both companies are well known for making field programmable gate arrays. The description of a preferred embodiment herein refers to an anti-aliased foreground textual image for the source of foreground image signal 106. It is believed that the present invention will provide significant benefits for anti-aliased input signals.

It is assumed that the source of background image signal 104 and source of foreground image signal 106 are compatible display formats and are mapped with a common or convertible pixel identification scheme. The source of background image signal 104, source of foreground image signal 106 and modified combined image output 108 are shown as RGB, as it is assumed that each pixel to be displayed is comprised of red, green and blue individually addressable pixel color components. Of course, other colors or pixel description schemes could be used.

Maximum pixel color component intensity determination 110 is performed by looking at the drive signal for each pixel and determining what is the highest level of intensity for each pixel color component therein. A single pixel maximum intensity level is provided via pixel level maximum pixel color component intensity level 111 to background image signal modifying (subtracting) block 112. Background image signal modifying (subtracting) block 112 takes for each pixel level maximum pixel color component intensity level 111 and the corresponding source of background image signal 104, which includes intensity levels for all pixel color components and subtracts from the source of background image signal 104 the pixel level maximum pixel color component intensity level 111. Output from background image signal modifying (subtracting) block 112 is selectively dimmed background image signal 113, which is then combined with original foreground image signal 109 to create modified combined image output 108.

In operation, the FPGA operates generally as follows:

Two sources of RGB video signals are provided, one for the foreground and another for the background. The source of foreground image signal 106 is provided to the maximum pixel color component intensity determination 110 and the foreground signal and modified background signal combiner 114. At the maximum pixel color component intensity determination 110, the intensity of the brightest pixel color component for each pixel is determined, and a pixel level maximum pixel color component intensity level 111 is provided to the background image signal modifying (subtracting) block 112, where that maximum pixel color component intensity level is subtracted from every pixel color component in the corresponding pixel of the source of background image signal 104, thereby making a selectively and partially dimmed background image. The source of foreground image signal 106 is provided via original foreground image signal 109 to be combined at foreground signal and modified background signal combiner 114 with selectively dimmed background image signal 113 to create the modified combined image output 108.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A method of rendering anti-aliased foreground text on a graphical image background comprising the steps of:

providing an anti-aliased foreground textual signal and a background graphic image signal;

correlating a location on a display device with a pixel from each of a foreground textual image and a background graphical image;

determining a pixel color component maximum characteristic for each pixel in the anti-aliased foreground textual image and providing a report of such pixel color component maximum characteristic to a background image signal modifying block;

subtracting from each pixel color component in a background graphic image an amount equal to the pixel color component maximum characteristic for the corresponding pixel in the anti-aliased foreground textual image and thereby creating a selectively augmented background image;

wherein said selectively augmented background image is a pixel by pixel selectively dimmed image;

adding the anti-aliased foreground textual image to the selectively augmented background images on a pixel color component basis, thereby creating a combined and augmented image; and driving a display device with the combined and augmented image.

2. The method of claim 1 wherein said pixel color component maximum characteristic is a highest brightness level.

3. The method of claim 1 wherein said display device is an LCD.

4. The method of claim 1 wherein said step of determining a pixel color component maximum characteristic is performed by a field programmable gate array.

5. The method of claim 1 wherein said pixel color component maximum characteristic is a scalar quantity, and each pixel comprises a red, blue and green pixel color component.

6. An apparatus for providing a display of anti-aliased foreground and background images simultaneously on a single display comprising:

a display device which generates a display based upon receiving individual information for each of a plurality of individually addressable pixel color components in a plurality of pixels therein;

a computer processor generating an anti-aliased textual foreground image drive signal for driving said plurality of pixels and said plurality of individually addressable pixel color components;

a camera generating a graphical background image drive signal for driving said plurality of pixels and said plurality of individually addressable pixel color components; and a field programmable gate array configured to:

determine a maximum intensity level for all individually addressable pixel color components which form each of the plurality of pixels in the anti-aliased textual foreground image drive signal;

subtract, on a pixel by pixel basis, said maximum intensity level from a value for each pixel color component in a corresponding pixel in the graphical background image drive signal, to form a selectively dimmed background drive signal; and combining the selectively dimmed background drive signal with the anti-aliased textual foreground image drive signal to generate a combined display drive signal.

7. The apparatus of claim 6 wherein the display device is an LCD.

8. The apparatus of claim 6 wherein each pixel comprises a red pixel color component, a green pixel color component and a blue pixel color component.

9. An apparatus comprising:

a source of background image signals, comprising an RGB signal;

a source of foreground image signals, comprising an RGB signal; and an image signal combining semiconductor device configured to perform operations comprising:

maximum pixel color component intensity determination, where a maximum pixel color component intensity level is determined among a red, green and blue pixel color component for each pixel of a plurality of pixels;

the maximum pixel color component intensity level is provided for each pixel in the plurality of pixels;

a pixel by pixel dimmed background signal is created by a background image signal intensity subtraction on each pixel color component of each pixel from the source of background image signal where the maximum pixel color component intensity level for each pixel of said plurality of pixels is subtracted from every pixel color component in said each pixel of said plurality of pixels; and a combined dimmed background signal and foreground image signal is created by a summation of intensity levels.

10. The apparatus of claim 9 wherein the semiconductor device is a field programmable gate array.

11. The apparatus of claim 10 wherein the field programmable gate array is a non-application specific commercial off-the-shelf field programmable gate array.

12. The apparatus of claim 9 wherein the source of foreground signals is a computer.

13. The apparatus of claim 12 wherein the source of background image signal is a camera.

14. The apparatus of claim 13 wherein the camera is a video camera.

15. The apparatus of claim 14 wherein the semiconductor device comprises programmable logic components.

16. The apparatus of claim 15 wherein the semiconductor device is a field programmable gate array.

* * * * *